United States Patent [19]

Smith et al.

[11] 3,933,234

[45] Jan. 20, 1976

[54] DOCUMENT HANDLING ASSEMBLY FOR A PRINTER

[75] Inventors: Jack L. Smith, Oklahoma City; Darby A. Gray, Norman; Brian R. Sullivan, Oklahoma City, all of Okla.

[73] Assignee: Honeywell Information Systems, Inc., Waltham, Mass.

[22] Filed: Feb. 4, 1972

[21] Appl. No.: 223,589

[52] U.S. Cl. ..... 197/127 R; 197/135 A

[51] Int. Cl.[2] ..... B41J 13/00

[58] Field of Search ..... 197/127, 128, 135, 135 A, 197/136, 139; 235/61.9

[56] References Cited

UNITED STATES PATENTS

| | | | |
|---|---|---|---|
| 1,617,450 | 2/1927 | Knee | 197/135 |
| 2,916,129 | 12/1959 | Parker | 197/128 |
| 3,211,270 | 10/1965 | Templeton | 197/128 X |
| 3,625,333 | 12/1971 | Cortona et al. | 197/128 |

*Primary Examiner*—Edgar S. Burr
*Assistant Examiner*—R. T. Rader
*Attorney, Agent, or Firm*—Ronald T. Reiling

[57] ABSTRACT

A passbook handling assembly for positioning a passbook relative to a type carrier in a printer. The handling assembly includes document gripping fingers at the ends of pivoted arms. A servomotor causes the arms to pivot through an arc. The document gripping fingers raise or lower the gripped passbook as the arms move.

4 Claims, 4 Drawing Figures

DOCUMENT HANDLING ASSEMBLY FOR A PRINTER

BACKGROUND OF THE INVENTION

The present invention relates to the art of printing devices and more particularly to a document handling assembly for use in such devices.

It is a long-established practice for banks and other savings institutions to issue passbooks or bankbooks to holders of savings accounts. A typical passbook includes 10 to 12 blank pages bound together within a stiff paper cover. The passbook serves as the customer's record of transactions concerning his savings account. Each deposit or withdrawal is recorded in the passbook by the savings institution at the time of the transaction.

A customer holding a passbook and the savings institution which issued that passbook are both interested in seeing that entries are neatly made and that the passbook is kept in good condition for as long as possible. The savings institution is interested in seeing that entries are neatly made since the customer's image of the savings institution is likely to be based, at least in part, on the appearance of passbook entries. The savings institution is also interested in keeping the passbook in good condition for as long as possible so that it will not have to prematurely issue a new passbook. A customer expects to see properly aligned and spaced entries Entries which are skewed or which overlap may be hard for the customer to decipher. A customer may also wish to keep a passbook in good condition for as long as possible since it provides him with a convenient record of his past fortunes or misfortunes as the case may be.

Before savings institutions began to use data processing equipment, all passbook entries were hand written. If the teller making the passbook entries had a steady hand and a good pen, the customer could expect to have a neat passbook which would remain in good condition while all entry pages were being filled. When savings institutions began to use data processing equipment, they also began to use passbook printers for mechanically printing entries into customer passbooks.

The basic construction of known passbook printers is similar to the construction of conventional mechanical or electrical typewriters. The passbook is inserted between a driven, rotatable platen and one or more idler rollers which force the passbook into contact with the platen. Surface friction between the passbook and the driven platen permits the passbook to be positioned relative to a type carrier upon rotation of the platen. While this typewriter-like arrangement may be perfectly satisfactory for flexible material such as conventional typing paper, the arrangement has certain drawbacks in a passbook printer. The bending of the passbook about the rotatable platen can cause severe damage to the stiff binding of the passbook. Moreover, the passbook must often be manually aligned within the printer prior to printing to avoid skewed or overlapping entries. Even if the passbook is aligned correctly initially, it is not uncommon for the passbook to slip during rotation of the platen causing entries to be skewed or overlapped in spite of the best efforts of the operator.

SUMMARY OF THE INVENTION

The present invention is a passbook handling assembly for providing positive, slippage-free alignment of the passbook relative to a type carrier. An assembly constructed in accordance with the present invention will cause very little damage to the passbook even after repeated entries are made.

The invention includes document guiding means which constrain movements of a document to a predetermined path relative to a printing mechanism. The invention further includes document engaging means which grip the document at one or more places on the perimeter of the document. A controllable driving means is connected to the document engaging means. The controllable driving means drives the engaging means (and the gripped document) between print positions along the predetermined path.

DESCRIPTION OF THE DRAWINGS

While the specification concludes with claims particularly pointing out and distinctly claiming that which is regarded as the present invention, further details of a preferred embodiment of the invention along with its further objects and advantages may be more readily ascertained from the following detailed description when read in conjunction with the accompanying drawings wherein:

DETAILED DESCRIPTION

Figure 1:
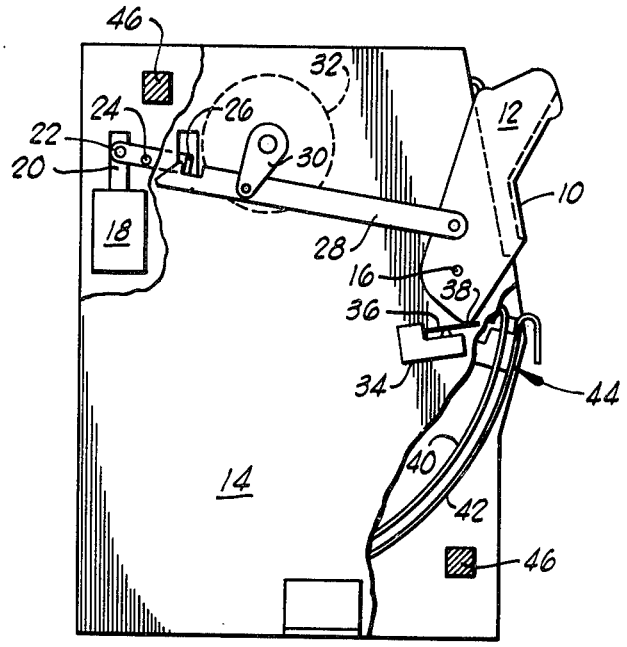
FIG. 1 is a side view of a passbook handling assembly constructed in accordance with the present invention showing loading/unloading linkages and a portion of a document guiding means.

Referring now to FIG. 1, a passbook handling assembly constructed in accordance with the present invention, preferably includes a passbook loading chute 10 having a funnel shaped opening 12 into which an operator can insert a passbook. The opening 12 is shown by dotted lines in FIG. 1 indicating that it would normally be hidden from view by end plates. Chute 10 is pivoted at points, including point 16, on opposite sides of an assembly housing 14. Chute 10 is movable between the closed or print position shown to an open or loading position. To load a passbook into the opening 12 of chute 10, an operator depresses a key or other control device to actuate a chute-latching solenoid 18 shown in the upper left hand corner of housing 14. When solenoid 18 is actuated, its armature 20 retracts causing an attached L-shaped lever 22 to pivot in a counterclockwise direction about a pivot point 24. The free end of L-shaped lever 22 includes an extension 26 which is normally seated in a notch in a link 28 unless lifted clear of the notch by actuation of the solenoid 18. Once extension 26 is clear of the notch, the chute 10 is unlatched and can be pulled outwardly or in a clockwise direction to its loading position. The link 28 and a crank 30 pivotally connected to the link are moved to the right when the chute moves to its loading position.

Crank 30 is connected to a rotary solenoid 32 shown only by dotted outlines since it is hidden by sidewalls of the housing 14. The function of this solenoid is explained later.

With the chute 10 in its loading position, an operator can readily insert a passbook into the opening 12 and push the chute 10 counterclockwise toward its print position. If the operator forgets to move the chute 10 to the print position before attempting to print an entry into the passbook, logic circuitry (not shown) will prevent printing operations and will also cause rotary solenoid 32 to be actuated. When solenoid 32 is actuated, it causes crank 30 to rotate in a clockwise direction to draw the chute 10 back into the print position. Chute 10 is latched in the print position by de-energizing solenoid 18 to cause extension 26 of lever 22 to drop into the notch in link 28. A signal indicating that the chute 10 is in the print position is obtained from a switch 34 mounted on the sidewall of housing 14. A leaf 36 on the switch 34 is cammed downwardly by a rounded edge 38 on the sidewall of chute 10 when the chute is rotated to the print position.

The lower right hand corner of the assembly is broken away to illustrate an inner guide 40 and an outer guide 42 which constrain movement of a passbook to a predetermined path. Also shown is the end of a document engaging means 44 which moves along the path defined by the guides 40 and 42. The construction and operation of the document engaging means 44 is described in more detail below.

Figure 2:
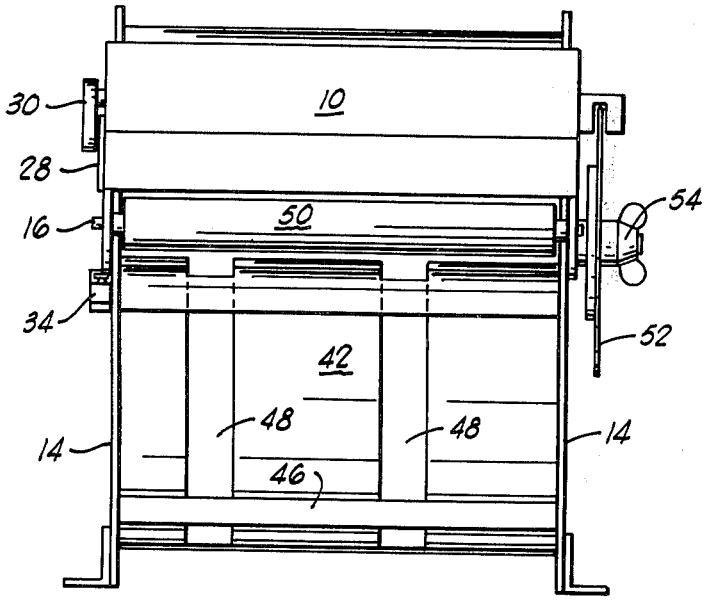
FIG. 2 is a front view of the passbook handling assembly shown in FIG. 1.

The cross-hatched squares 46 shown in FIG. 1 are struts which connect opposite sidewalls of the housing 14. One of the struts is shown in the front view of FIG. 2. Referring to that Figure, it may be seen that the document guides, only outer guide 42 of which is visible, are pieces of sheet metal containing parallel slots 48. Document engaging means 44 includes two lift arm assemblies which move along the slots 48. The lift arm assemblies are connected together at a pivot arm described in more detail below. A rotatable platen 50 is mounted between the sidewalls of the housing 14. The platen 50 is located at the impact point of a type carrier to support a passbook during printing operations.

The angular position of the document engaging means 44 controls the vertical position of a passbook relative to a type carrier in line with the rotatable platen 50. The angular position of the document engaging means 44 is, in turn, controlled by a servomotor which can be stepped between print positions through the use of a conventional shaft encoder including an encoding disk 52 secured to the shaft of the servomotor by means of a wing nut 54. The use of a wing nut 54 to secure the encoding disk 52 to the motor shaft makes it possible to change disks to accommodate passbooks of different sizes or to print entries at different line spacings.

Figure 3:
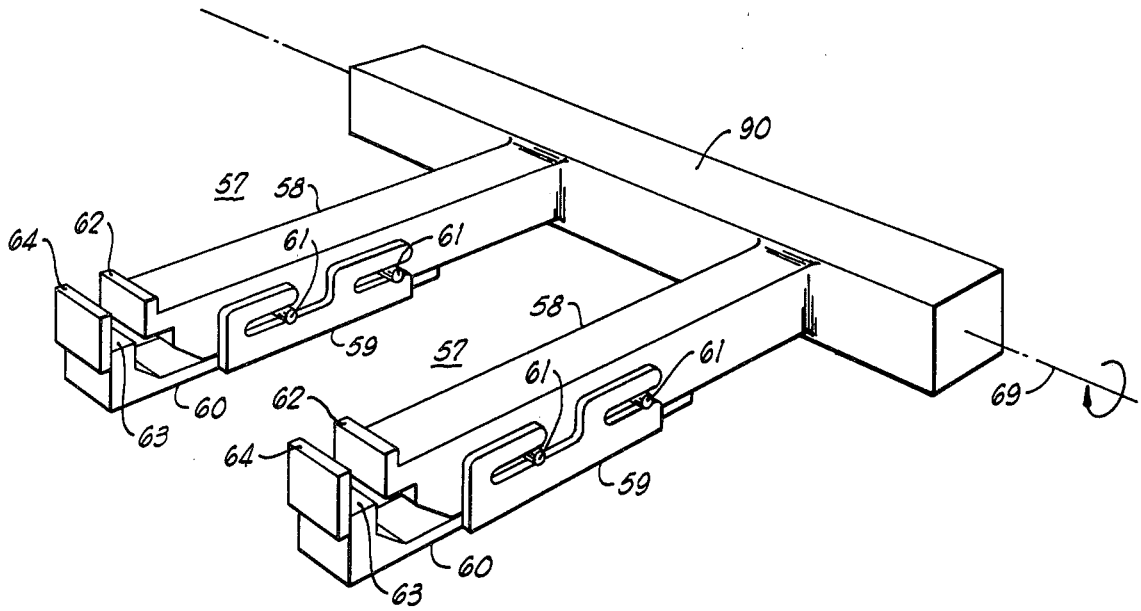
FIG. 3 is an enlarged perspective view of one embodiment of document engaging means suitable for use in the present invention.

Referring to FIG. 3, the document engaging means 44 includes two lift arm assemblies 57 each having an upper arm 58 and a lower arm 60 which is held against the underside of upper arm 58 by a U-shaped bracket 59 that cradles lower arm 60. The bracket 59 is attached to or integral with lower arm 60 but rides on pins 61 protruding from the sides of upper arm 58 to permit the lower arm 60 to slide along upper arm 58. The two upper arms are connected to a pivot arm 90 which can be rotated about an axis 69 by a servomotor, as will be described in more detail below. The free end of upper arm 58 includes a finger 62. The free end of lower arm 60 includes another finger 64 attached to a ledge 63. The arms 58 and 60 are illustrated in their open position. In their closed position, the fingers 62 and 64 are urged toward one another to grip the perimeter of a passbook near its bottom edge.

Figure 4:
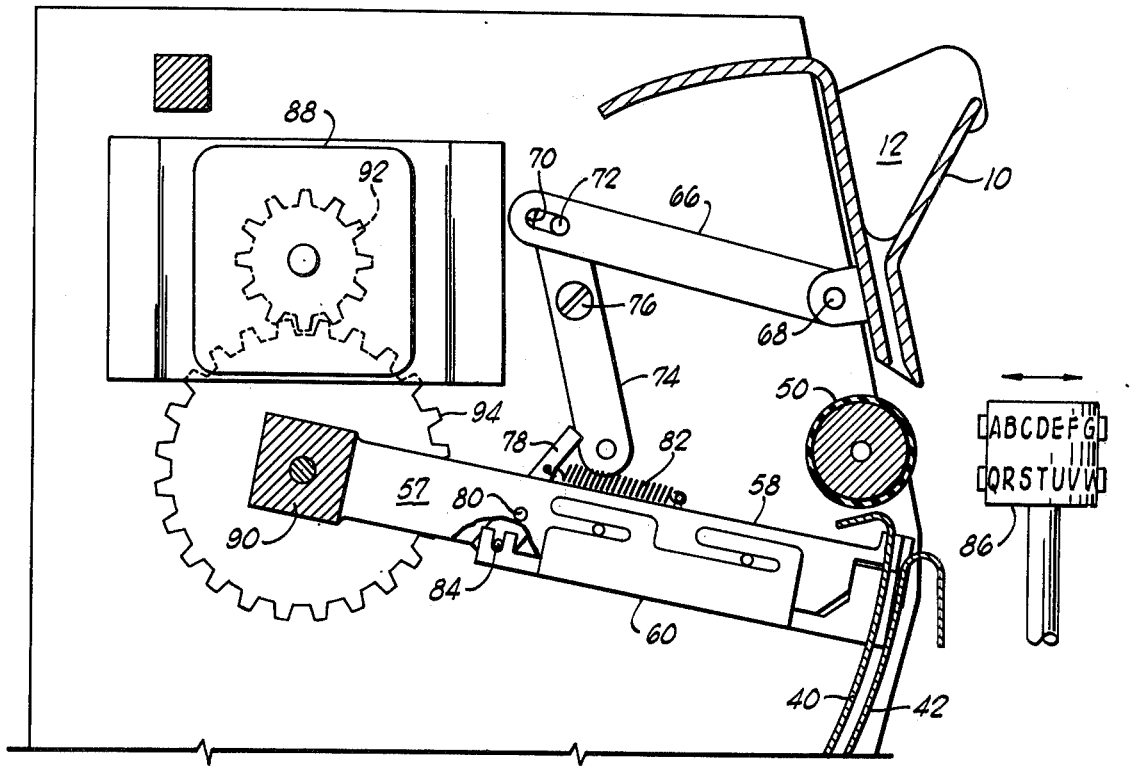
FIG. 4 is a more detailed side view of the passbook handling assembly showing the linkages and elements needed to grip and move a passbook relative to a type carrier.

The mechanisms used to open and close the fingers 62 and 64 and to drive the lift arm assemblies 57 are shown in more detail in FIG. 4. In FIG. 4, the sidewall of the chute 10 has been removed to show the funnel shaped opening 12 in slightly more detail.

The fingers 62 and 64 at the end of each lift arm assembly 57 open automatically when the chute 10 is pulled to its loading position and close automatically when the chute 10 is pushed or drawn to its print position. The controlling linkage includes an arm 66 connected to the chute 10 at a pivot point 68. The left end of the arm 66 includes the slot 70 encompassing a pin 72 at one end of lever 74. Movement of the chute 10 toward its loading position causes arm 66 to move to the right. When the pin 72 contacts the left end of slot 70 in moving arm 66, the upper end of lever 74 is pulled to the right causing lever 74 to rotate in a clockwise direction about a pivot point 76. The clockwise rotation of lever 74 forces a smaller lever 78 to pivot counterclockwise about a pivot point 80 in the upper arm 58. This movement of the small lever 78 is opposed by a coil spring 82 rigidly attached to pins on the lever 78 and the upper arm 58. The counterclockwise rotation of small lever 78 about its pivot point 80 causes a pin 84 at the lower end of lever 78 to push the lower arm 60 to the right relative to the upper arm 58. The relative movement of the two arms 58 and 60 separates the fingers 62 and 64. The bottom edge of a passbook inserted into chute 10 will be seated against the ledge 63 shown in FIG. 3.

When chute 10 is moved toward its print position either by the operator or by operation of the rotary solenoid 32, the leftward movement of arm 66 causes lever 74 to pivot in a counterclockwise direction. The movement of lever 74 permits the coil spring 82 to draw lever 78 to its extreme clockwise position. Consequently, pin 84 draws the lower arm 60 to the left relative to the upper arm 58, causing the fingers 62 and 64 to converge on the passbook seated between them.

A servomotor 88 is coupled to a pivot arm 90 for the lift arm assemblies 57 through a gear train consisting of a small gear 92 mounted on the motor shaft and a larger gear 94 immovably connected to pivot arm 90.

Because the pair of lift arm assemblies are rigidly connected and can move vertically only in synchronism, the document gripped by the fingers 62 and 64 and moving between guides 40 and 42 is positively aligned with respect to type carrier 86 at all times during the same printing operation and during printing operations performed at different times. Successive entries cannot be skewed and cannot overlap.

Since a passbook is lifted or lowered along the guides 40 and 42 by the pair of lift arm assemblies and is not positioned by platen friction, the passbook need not be wrapped around a platen as was done in prior art passbook printers. A slight curvature is formed in the passbook by locating the idler platen 50 near the edge of the path defined by the guides 40 and 42 and the opening 12 in chute 10. This slight curvature, although unnecessary for positioning of the passbook, may enhance the quality of print. Since the amount of curvature is slight, there should be little or no damage to the binding of the passbook.

While there has been described what is believed to be a preferred embodiment of the invention, variations and modifications of the invention will occur to those skilled in the art. For example, the lift arm assemblies are shown moving along an arcuate path. It would be obvious to one skilled in the art to provide lift arm assemblies movable along a linear path. Similarly, the invention might be used with an electrostatic or other non-contacting printing mechanism rather than the contact-type printing mechanism illustrated herein. Therefore, it is intended that the appended claims shall be construed as including all such variations and modifications as fall within the true spirit and scope of the invention.

1. For use in a document printer having a printing mechanism, a document handling assembly for positioning a document relative to the printing mechanism comprising:

a. document guiding means for constraining movement of the document to a predetermined path relative to the printing mechanism;

b. document engaging means including movable fingers for gripping the lower edge of a document at one or more places to hold the document during movement along a generally vertical predetermined path; and c. controllable driving means connected to said document engaging means for driving said engaging means between print positions along the predetermined path.

2. A document handling assembly as recited in claim 1 wherein said document engaging means further includes:

a. pivotally mounted arm assemblies having the movable fingers located at the unpivoted end thereof; and b. means for coupling said arm assemblies to said controllable driving means to allow said driving means to rotate said arm members through an arc.

3. A document handling assembly as recited in claim 2 further including a platen member located on the opposite side of the document from the printing mechanism for preventing document displacement upon actuation of the printing mechanism.

4. A document handling assembly as recited in claim 3 wherein said platen member comprises a roller positioned in part in the predetermined path to slightly curve the document in the area to be printed by the printing mechanism.

* * * * *